United States Patent [19]

Davis

[11] Patent Number: 4,674,447

[45] Date of Patent: Jun. 23, 1987

[54] PREVENTION OF FOULING IN INTERNAL COMBUSTION ENGINES AND THEIR EXHAUST SYSTEMS AND IMPROVED GASOLINE COMPOSITIONS

[76] Inventor: Robert E. Davis, 125 Hillcrest Dr., Hinsdale, Ill. 60521

[21] Appl. No.: 153,012

[22] Filed: May 27, 1980

[51] Int. Cl.[4] ..... F02B 75/12

[52] U.S. Cl. ..... 123/1 A; 123/198 A; 44/68

[58] Field of Search ..... 123/1 A, 198 A; 44/68; 60/299

[56] References Cited

U.S. PATENT DOCUMENTS

| | | | |
|---|---|---|---|
| 2,818,417 | 12/1957 | Brown et al. | 123/1 A |
| 3,110,577 | 11/1963 | Brown et al. | 44/68 |
| 3,127,351 | 3/1964 | Brown et al. | 44/68 |
| 3,996,740 | 12/1976 | Niebylski | 60/299 |

*Primary Examiner*—E. Rollins Cross
*Attorney, Agent, or Firm*—Keil & Weinkauf

[57] ABSTRACT

Processes for operating gasoline engines with spark plug ignition of gasolines containing manganese compound additives such as pentadienyl manganese tricarbonyl (MMT), the gasoline being essentially free of lead, sodium and barium compounds, thereby avoiding fouling of the spark plugs with glass-like deposits formed from the oxide reaction products of sodium or barium and manganese; the lubricating oils in the crankcase of said engines being essentially free from lead, sodium and barium compounds; processes for operating gasoline engines having an exhaust system with a catalytic converter for conversion of hydrocarbon emissions and carbon monoxide emissions to water and carbon dioxide with the same types of gasolines, and preventing fouling of the catalyst in said converter by glass-like deposits formed thereon by oxidation products of sodium and/or barium compounds with manganese by operating said engine in the absence of lead, sodium and barium compounds in the combustion chambers of the engine, its exhaust system, and the crankcase lubricating oils; and gasoline fuels for internal combustion engines containing a small amount of a manganese compound additive, e.g., MMT, said gasoline being essentially free of lead, sodium and barium compounds.

18 Claims, 2 Drawing Figures

Figure 1:
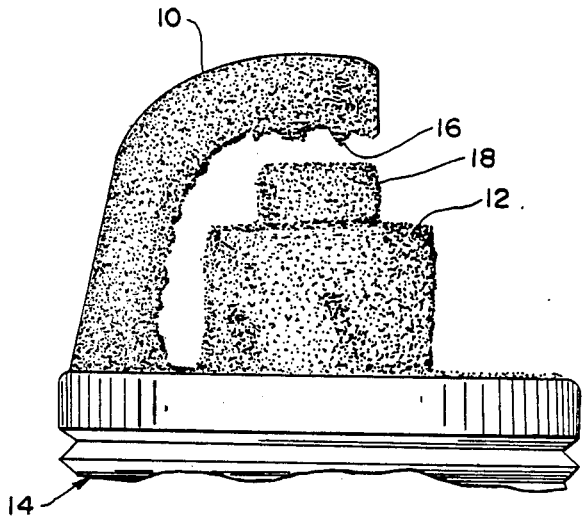

PREVENTION OF FOULING IN INTERNAL COMBUSTION ENGINES AND THEIR EXHAUST SYSTEMS AND IMPROVED GASOLINE COMPOSITIONS

STATEMENT OF THE INVENTION

This invention pertains to improvements in the operation of gasoline internal combustion engines in which the gasoline contains an organic manganese compound such as methylcyclopentadienyl manganese tricarbonyl (hereafter abbreviated MMT) and to improvements in gasoline compositions containing an organic manganese compound. The invention herein centers on the discoveries that it is essential to substantially completely eliminate from the combustion portions of engines fueled with gasolines containing manganese compound additives such as MMT, i.e., from the gasoline and the crankcase lubricating oils, organic and inorganic compounds of sodium and barrium, and also compounds of lead. Such eliminations improve hydrocarbon engine-out emissions, reduces spark plug fouling, and reduce fouling and plugging of catalysts in catalyst exhaust gas converters.

Organic manganese compounds such as MMT, during the combustion of gasoline in the engine, are oxidized to inorganic oxides of manganese, principally $Mn_3O_4$. These manganese oxides have been found to be an aggrevating source of spark plug fouling and also fouling of catalytic surfaces in catalytic converters of automobile exhaust systems when the engine's combustion mixtures and exhaust gases also contain even small amounts of sodium compounds and/or barium compounds. In accord with the discoveries herein set forth, the gasoline and/or lubricating oil in the crankcase should be essentially or completely free from organic and inorganic compounds of sodium and manganese and in no case should there be more than about 30 ppm, as Na and Ba.

I have discovered that manganese compounds plus sodium compounds and/or barium compounds oxidize, during combustion of the gasoline, to produce glass-like, composite oxides of Mn and Na, Mn and Ba and/or Mn, Na and Ba. These glass-like oxides deposit on spark plug surfaces and act like an insulator on the electrode surfaces of the plugs—thereby interfering with the proper sparking across the plugs' gaps.

Lead in the form of lead alkyls, e.g., tetraethyl lead, has been used for years as a gasoline additive to improve octane ratings, serving as an anti-detonating (anti-knock) compound. It is a known catalyst poison for the platinum and palladium catalysts used in automobile exhaust catalytic converters. Laws and regulations prohibit use of lead compounds in gasolines for vehicles having such catalytic converters.

MMT has been discovered by others to be an octane improver and anti-detonating compound in gasoline when used in amounts in the order of 1/32 gram Mn per gallon of gasoline and upwards, preferably in the order of 1/32 to 1/16 gram Mn per gallon of gasoline.

BACKGROUND

Data presented to the Emission Control Technology Division of the U.S. Environmental Protection Agency indicates some problems from using MMT at 1/32 gram Mn and 1/16 gram Mn levels with regard to exhaust gas hydrocarbon and/or carbon monoxide emissions and with regard to effect of MMT on an oxygen sensor used in three-way catalyst systems.

Three-way catalyst systems are designed to operate with exhaust gas from the engine that results from operation at close to the stoichiometric or chemically correct air/fuel ratio. With such a feedgas, the catalyst simultaneously controls HC, CO, and NOx emissions. An oxygen sensor is used with these systems as the sensor in a feedback control system which maintains the air/fuel ratio at the stoichiometric point by controlling the fuel metering system. Any deterioration of the oxygen sensor's ability to provide the appropriate signal for the feedback control system may result in a corresponding deterioration in emission control capability.

Improved oxygen sensors which are less sensitive to MMT have become available. Further, the sensitivity problem is of less concern where the three-way catalyst system employs air injection into the exhaust gas downstream of the three-way catalyst and ahead of an oxidation catalyst.

Also, studies of automotive engines run on MMT-containing gasoline with 1/32 g Mn/gal and 1/16 g Mn/gal indicate an increase in combustion chamber deposits and a resultant increase in engine-out HC emissions.

It has been proposed that an oxidation catalyst is enhanced in its oxidation potential by the presence of $Mn_3O_4$ on the catalyst due to the combustion of MMT. $Mn_3O_4$ is a weak oxidizing material by virtue of its ability to be reduced to MnO under rich conditions.

Automotive vehicle manufacturers have expressed concern with exhaust gas catalyst plugging—especially in light and medium duty truck engines. Early work showed the potential for catalyst plugging when vehicles were fueled with MMT gasoline (usually at the $\frac{1}{8}$MMT level). In-depth studies of the plugging instances have related plugging to catalyst temperatures and flow variation, with high temperature, steady state operation having the greatest potential for catalyst plugging.

Manufacturers also have expressed concern about the impact of MMT plugging on efforts to meet light and medium duty truck emissions standards using oxidation catalysts. These catalysts have higher operating temperatures due to higher load operation and will be more subject to catalyst plugging problems than light duty vehicles. Also, foreign manufacturers have produced vehicles that operate at higher load and temperature than their domestic counterparts. These vehicles may be more susceptible to MMT catalyst plugging because of their smaller, highly loaded engines.

Additives in crankcase lubricating oils can also be a source of problems with the foregoing adverse effects of MMT-containing gasoline, as illustrated in a report in *Automotive Engineering,* November 1979, which reports on studies conducted by a large, U.S. automobile and truck manufacturer on both catalyst and oxygen sensor performance. The sensor is located in the exhaust stream ahead of the catalytic converter. Catalyst HC conversion efficiency at stoichiometric air/fuel (A/F) ratio and CO-$NO_x$ crossover efficiency decreased with increased amounts of zinc dialkyldithiophosphate (ZDP) in the lubricating oil and with increased phosphorus found on the catalyst. Alkaline metal additives in the oil reduced the amount of ZDP-derived phosphorus retained by the catalyst and reduced the deleterious effect of phosphorus on HC conversion efficiency, but had no effect on the reduction in CO-NOx crossover efficiency. Alkaline metal additives had no effect on sensor performance.

The sensor consisted of a zirconia element separating two platinum electrodes. The inner electrode is exposed to ambient air supplied through a hollow center terminal. The outer electrode is contacted by exhaust gases which pass through a louvered metal shield. At engine operating temperatures, the zirconia-platinum element acts as a galvanic cell.

The catalyst contains platinum (0.045 mass percent) and rhodium (0.019 mass percent) dispersed in a spherical shell near the surface of the alumina support pellets.

Since crankcase lubricating oils migrate, depending on engine wear conditions, into the combustion chamber, it is evident that sodium or barium compounds therein can be a source, in the presence of MMT in the gasoline, for the troublesome glass-like oxides of Na and Mn, Ba and Mn and/or Na, Ba and Mn, discussed above. Accordingly, it is desirable, if not essential, to exclude from crankcase lubricating oils, as well as from gasoline, organic and inorganic compounds of sodium and barium.

THE INVENTION

The invention herein is based on my discovery that the fouling deposits on combustion chambers, spark plugs and exhaust gas catalysts of internal combustion engines fueled with gasolines containing small amounts of methylcyclopentadienyl manganese tricarbonyl (MMT) can be eliminated or reduced if sodium compounds and barium compounds are excluded completely or essentially from the combustion portions of the engine and preferably also from its exhaust system. The primary liquids from which the sodium compounds and barium compounds should be completely or essentially excluded are the MMT-containing gasoline (or any other gasoline ultimately mixed therewith at the distribution, retail or consumer levels), crankcase lubricating oils likely to be used in MMT-gasoline-fueled vehicles, and additives added separately at the retail or consumer level to MMT-containing gasoline or the crankcase lubricating oils. The major benefit is elimination of glass-like deposits of oxides of sodium and manganese, oxides of barium and manganese, and/or oxides or sodium, barium and manganese on walls and pistons in combustion chambers of the engines, on spark plugs, especially its electrodes, and on or within monolithic and pelleted hydrocarbon-, CO-and/or $NO_x$— converting catalysts used in automotive exhaust systems.

Figure 2:
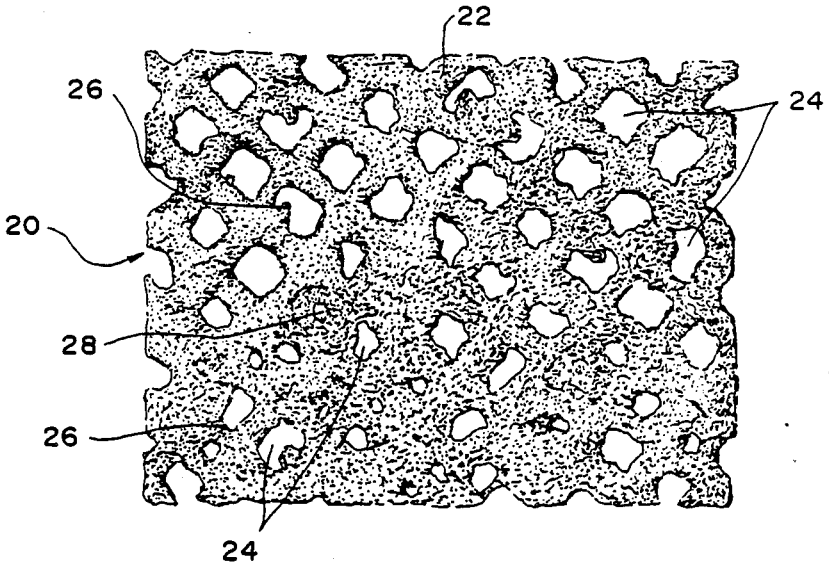

Fouling of a spark plug and fouling (plugging) of a monolithic exhaust gas catalyst are illustrated in the drawings, wherein FIG. 1 is a side elevation of a segment of a fouled spark plug; and FIG. 2 is a plan view of a fragment of a deposit-plugged, monolithic, exhaust gas catalyst.

Referring to the drawings, the electrodes 10 and 12 of the spark plug 14, and adjacent parts thereof, have become coated with irregular deposits 16 and 18 of glass-like character. These deposits were formed during operation of an internal combustion engine, the gasoline for which contained both MMT and a sodium compound. The glass-like deposits are oxides of manganese and sodium and has electrical-insulating properties. Accordingly, they interfere with the sparking across the gap between electrodes. The result is less than complete combustion of the gasoline fuel—leading to increase engine-out hydrocarbon emissions.

The monolithic catalyst 20 is an open mesh 22 coated by platinum with or without palladium and/or rhodium. Many of the small interstices 24 have become partly or essentially completely plugged by surface deposits 26 and a larger piece 28 of the aforesaid glass-like oxide deposits of oxides of sodium and/or barium and manganese. These result in decreased efficiencies of hydrocarbon and/or carbon monoxide conversions and hence higher than normal hydrocarbon and/or carbon monoxide emissions and, with three-way catalyst systems, higher than normal NOx emissions.

Deposit samples, when analyzed by X-ray diffraction, showed a phase based on $Mn_3O_4$ (ASTM Card No. 16-154). The data when compared with a quartz standard was sufficiently different from the data on ASTM Card No. 16-154 so as to indicate a different (altered) $Mn_3O_4$ crystalline structure. Indications were that the deposit samples may contain smaller amounts of $MnO_2$ (ASTM card No. 7-222), $Mn_3O_4$ (card No. 13-162 and possibly $\gamma Mn_2O_3$ (ASTM card No. 6-0549).

Further analysis of the same samples plus other deposits which did not show catalyst plugging tendencies were made by the ISS-SIMMS method. ISS is relatively simple in principle and application. A monoenergetic beam of positive ions (such as: $^3He+$, $^4He+$, or $^{10}Ne+$) is directed at the specimen surface. The low energy ions (0.5 to 5.0 keV) are scattered from atoms on that surface with an energy loss consistent with a simple binary scattering event. The energy of ions reflected back from the specimen at a particular angle (138° in the ISS instrument) is directly related to the masses of both the probe ion and the surface atom. Simply recording the number of scattered ions as a function of their energies results in a spectrum in which each surface element gives rise to a unique peak.

ISS is especially sensitive to high-mass elements (atomic number $>22$), and the signal is directly related to the atomic concentrations at the surface. It is essentially independent of matrix effects (the effects of other atoms in the surface's matrix) which permits a convenient direct representation of the actual surfaces concentrations approximately. Quantitative analyses are accomplished by normalizing the measured peak intensities using previously reported elemental sensitivities. Detection limits on the order of a few ppm can be realized for high-mass elements such as As or Sb in a Si matrix.

SIMS takes advantage of the surface erosion caused by the collisions of the primary ion beam. As the surface is sputtered away, that material includes positive and negative ions. Extracting these ion from the target area using an appropriate energy filter and focusing them into a mass spectrometer permits analysis of their masses. The SIMS process is thus the technique of analyzing the mass and intensity of the ions sputtered from a specimen surface by an incident beam of monoenergetic, inert-gas ions.

In SIMS the relative instrumental sensitivities to the elements can vary over a range of about five orders of magnitude. Furthermore, the ion yield (sensitivity) is strongly dependent upon the matrix of which the specific atom is a part. Thus, actual surface concentrations may be quite different than the ion intensities observed in a given spectrum. Although techniques exist for obtaining semi-quantitative SIMS results, they generally involve extensive reference materials and calculations or are restricted to specific types of samples.

The samples were analyzed using an imaging technique to determine the location of metals previously confirmed by X-ray fluoresence. The results of this work conclusively demonstrate that manganese is deposited with sodium. In comparing the sodium image with the manganese image, it was noted that the location of both metals is essentially identical.

A deposit sample which did not exhibit plugging was imaged and found to contain no co-deposit of sodium. It demonstrated random deposit characteristics. A fourth deposit sample known to not contain sodium was analyzed using the Secondary Ion Mass Spectroscopy Profiling technique. The results of this analysis indicate that barium is uniformly deposited throughout the residue with the manganese.

The spark plugs from the engines exhibiting catalyst plugging tendencies were analyzed by Tube Excited Fluorescence Analysis. Without exception, the deposits contained on the plugs are essentially identical elementally to those on the catalyst surface.

The limit of resolution of a microscope is directly related to the wavelength of light utilized for observation. Hence, to resolve objects of atomic or molecular size, one must use light with wavelengths of the order of 1 angstrom.

Electron microscopy takes advantage of the dual wave-particle nature of matter. If an electron is accelerated by a high voltage (ca. 100,000 volts), the De Broglie wavelength associated with the resulting high-energy electron is about 1/30 angstrom. Using "light" with such short wavelength one is able to "see" objects of atomic and molecular sizes.

Unfortunately, the high energy imparted to the electrons to decrease their wavelengths to atomic dimensions is partially transferred to the atoms in the sample. Because this transferred energy introduces additional motion to the atoms in the sample, the actual resolution of electron microscopy is somewhat poorer than the theoretical limit. The currently available resolution limit is about 1- angstroms, and large atoms appear as fuzzy balls in photographs.

In scanning electron microscopy the sample is irradiated with a finely focused electron beam which is scanned across the sample in a television-raster pattern. A detector that is sensitive to the chosen output signal (secondary electrons, backscattered electrons, characteristic x-rays, etc.) from the sample is connected through a video amplifier to the grid of a cathode-ray tube that is scanned synchronistically with the beam on the sample. Here, the brightness at any point on the screen will depend on the strength of the signal from the corresponding point on the sample. In this way, an image of the sample's surface is built up on the cathode-ray-tube screen point by point. If, for example, the detector is sensitive to x-rays and is tuned to the characteristic energy for a specific element, then one obtains the two dimensional distribution of that chemical element on the surface being scanned.

Additional verifications were made with a scanning electron microscope to map the elements in the deposit residues.

The results of the analyses described above indicate that the deposits formed in the combustion chamber are compounds based on the oxides of manganese. However, the deposits which contain calcium, for example, differ distinctively from those which contain sodium and/or barium.

One important difference seems to arise from the lower melting point of the sodium-and/or barium-containing deposit. These deposits fuse at the normal temperatures of the combustion chamber, and the resulting glass-like material is deposited on the electrodes and insulators of the spark plugs. These deposits are electrical insulators as indicated by measurements with a JET VOM. Those insulating deposits, of course, interfere with the proper electrical discharge in the combustion chamber and thereby give rise to higher engine-out emissions.

The calcium-containing deposits, on the other hand, do not fuse (presumably because of their higher melting points) and do not form the glass-like deposits on the electrodes of the spark plugs. Hence, the calcium-manganese-oxygen compounds do not interfere with proper spark plug performance and do not give rise to higher engine-out emissions.

It thus appears that the gasoline additive MMT, in the absence of other materials (such as sodium and barium compounds) which are capable of forming deposits with a sufficiently low melting point that they fuse within the combustion chamber, does not form deposits that interfere with the proper function of spark plugs and catalysts. Therefore, MMT may be used as a gasoline additive without impairing the quality of the engine emissions if sodium- and barium-containing compounds, for example, are excluded from the engine. Calcium-containing compounds are examples of appropriate, nondetrimental substitutes for the barium- and sodium-containing compounds.

SUMMARY

Based on the foregoing discoveries, the complete or essentially complete elimination of sodium compounds and barium compounds from the air MMT-containing gasoline lubricating oil composites which are ignited in the combustion chambers of internal combustion engines, especially those with spark ignition, has the overall advantage of reducing hydrocarbon engine-out emissions and CO engine-out emissions. These reductions are attributed to substantial decreases of manganese oxide-containing deposits on combustion chamber surfaces, on spark plug electrodes, and on or in catalysts (pellets or monoliths) in exhaust gas catalytic converters, wherein the primary catalytic components are platinum, palladium and/or rhodium. The invention further offers the advantage of reducing manganese oxide-containing deposits on or in the catalysts used to reduce $NO_x$ gases in three-way catalyst systems and/or on oxygen sensor probes used with the three-way systems to monitor and control oxygen content of the combustion gases to levels facilitating the $NO_x$ reductions.

Therefore, the invention concerns:

(a) Processes for operating gasoline engines with spark plug ignition of a gasoline containing a manganese compound additive, e.g., methylcyclopentadienyl manganese tricarbonyl (MMT), such a gasoline containing a small amount (1/32 gram Mn per gallon or above), and the gasoline being essentially free of sodium and barium inorganic and organic compounds, thereby avoiding fouling of the spark plug electrodes with glass-like oxide deposits formed from the combustion reaction products of the sodium or barium compounds and the manganese compound, e.g., MMT. Since crankcase lubricating oil finds its way into the combustion chambers, the lubricating oil in the crankcase of the engines also should be essentially free from sodium and barium compounds. Small amounts of sodium and/or barium compounds can be tolerated if necessary, but it is most preferred that the sodium and barium compounds in said lubricating oil and in said gasoline each be less than 100 ppm, as Na and Ba.

(b) Processes for operating gasoline engines having an exhaust system with a catalytic converter for conversion of hydrocarbon emissions and carbon monoxide emissions to water and carbon dioxide, the fuel used to operate said engines being gasoline containing a small amount (1/32 gram Mn per gallon or above) of a manganese compound additive; e.g. methylcyclopentadienyl manganese tricarbonyl (MMT) and preventing fouling and plugging of the pelleted or monolithic catalysts in said converter by glass-like deposits formed thereon by combustion oxidation products of sodium and/or barium compounds with manganese by operating said engine essentially in the absence of sodium and barium compounds in the combustion chambers of the engine and its exhaust system, and also avoiding catalyst poisoning by lead by excluding essentially all lead compounds from the combustion chambers. The crankcase lubricating oil in the crankcase of the engine also should be essentially free from lead, sodium and barium compounds. Small amounts of sodium and/or barium compounds can be tolerated if necessary, but is most preferred that the amount of sodium and barium compounds in said lubricating oil and in said gasoline each be less than 30 ppm, as Na and Ba.

(c) Gasoline fuels for internal combustion engines containing a small amount (1/32 gram Mn per gallon or above) of a manganese compound additive, e.g., methylcyclopentadienyl manganese tricarbonyl (MMT), the gasoline being essentially free of lead, sodium and barium organic and inorganic compounds, but, where necessary, containing small, allowable amounts in said gasoline of less than 30 ppm of sodium and barium compounds, as Na and Ba.

The invention is claimed as follows:

1. A process for operating gasoline engines with spark plug ignition which use a gasoline fuel containing methylcyclopentadienyl manganese tricarbonyl which comprises:

using as the gasoline fuel for said engines a gasoline containing methylcyclopentadienyl manganese tricarbonyl as an octane improver but containing no additives which include sodium or barium compounds; whereby fouling of the spark plugs with glass-like deposits formed from the oxidation reaction products of sodium and/or barium and manganese is avoided.

2. A process as claimed in claim 1 wherein the lubricating oil in the crankcase of said engine contains no additives which include sodium and barium compounds.

3. A process as claimed in claim 2 wherein the amount of sodium and barium compounds in said lubricating oil and in said gasoline is less than 30 ppm, as Na and Ba.

4. A process as claimed in claim 1 wherein the amount of sodium and barium compounds in said gasoline is less than 30 ppm, as Na and Ba.

5. A process for operating gasoline engines having exhaust system s with catalytic converter s for conversion of hydrocarbon emissions and carbon monoxide emissions to water and carbon dioxide while preventing fouling and plugging of the catalyst in said converters by glass-like deposits formed thereon by oxidation products of sodium and/or barium with manganese' which comprises operating said engines using as the fuel gasoline containing methylcyclopentadienyl manganese tricarbonyl as an octane enhancer but containing no additives which include sodium or barium compounds.

6. A process as claimed in claim 5 wherein the lubricating oil in the crankcase of said engine contains no additives which include sodium and barium compounds.

7. A process as claimed in claim 6 wherein the amount of sodium and barium compounds in said lubricating oil and in said gasoline is less than 30 ppm, as Na and Ba.

8. A process as claimed in claim 5 wherein the amount of sodium and barium compounds in said gasoline is less than 30 ppm, as Na and Ba.

9. A gasoline fuel for internal combustion engines which comprises gasoline containing methylcyclopentadienyl manganese tricarbonyl as an octane improver; said gasoline being free of lead compounds and free of additives containing sodium and barium compounds.

10. A gasoline fuel as claimed in claim 9 wherein said gasoline contains less than 30 ppm of sodium and barium compounds, as Na and Ba.

11. A process for operating gasoline engines with spark plug ignition which use gasoline containing a manganese compound additive which comprises;

using as the gasoline fuel for said engines a gasoline containing a manganese compound additives containing sodium and barium compounds, whereby fouling of the spark plugs with glass-like deposits formed from the oxidation reaction products of sodium and/or barium and manganese is avoided.

12. A process as claimed in claim 11 wherein the lubricating oil in the crankcase of said engine contains no additives which include sodium and barium compounds.

13. A process as claimed in claim 11 wherein the amount of sodium and barium compounds in said gasoline is less than 30 ppm, as Na and Ba.

14. A process for operating gasoline engines having exhaust system s with catalytic converter s for conversion of hydrocarbon emissions and carbon monoxide emissions to water and carbon dioxide while preventing fouling and plugging of the catalyst in said converters by glass-like deposits formed thereon by oxidation products of sodium and/or barium with manganese; which comprises operating said engines using as the fuel gasoline containing a manganese compound additive as an octane enhancer but containing no additives which include sodium or barium compounds.

15. A process as claimed in claim 14 wherein the lubricating oil in the crankcase of said engine contains no additives which include sodium and barium compounds.

16. A process as claimed in claim 14 wherein the amount of sodium and barium compounds in said gasoline is less than 30 ppm, as Na and Ba.

17. A gasoline fuel for internal combustion engines which comprises gasoline containing a manganese compound additive in an amount providing at least 1/32 gram Mn per gallon of gasoline, and said gasoline being free of lead compounds and free of additives containing sodium and barium compounds.

18. A gasoline fuel as claimed in claim 17 wherein said gasoline contains less than 30 ppm of sodium and barium compounds, as Na and Ba.

* * * * *